United States Patent [19]

Sunray

[11] Patent Number: 4,655,719

[45] Date of Patent: Apr. 7, 1987

[54] DELAYED-RELEASE SUSPENSION DEVICE

[76] Inventor: Bernard Sunray, c/o R. Kaufman, Jeweler, 400 Northlake Blvd., North Palm Beach, Fla. 33408

[21] Appl. No.: 788,042

[22] Filed: Oct. 16, 1985

Related U.S. Application Data

[63] Continuation-in-part of Ser. No. 636,864, Aug. 2, 1984, abandoned.

[51] Int. Cl.[4] ..... A63H 27/22

[52] U.S. Cl. ..... 446/59; 446/62

[58] Field of Search ..... 446/57, 59, 60, 62; 248/496

[56] References Cited

U.S. PATENT DOCUMENTS

| | | | |
|---|---|---|---|
| 1,792,760 | 2/1931 | Pollock | 446/60 |
| 2,253,661 | 8/1941 | Teuschler | 446/60 |
| 3,128,574 | 4/1964 | Sunray . | |
| 3,174,252 | 3/1965 | Sunray . | |
| 3,360,229 | 12/1967 | Beyer | 248/496 |
| 3,964,189 | 6/1976 | Belokin, Jr. | 40/33 |

*Primary Examiner*—Mickey Yu

*Attorney, Agent, or Firm*—Shoemaker and Mattare, Ltd.

[57] ABSTRACT

A delayed-release suspension system for rubberband powered flying toys includes a wire-like hanger arm affixed to the forward end of a fuselage of an airplane, the hanger arm being inclined rearwardly at an angle from the vertical of 10° to 25° and provided midway thereof with a V-shaped notch. One end of a rubberband for use in powering the airplane has attached thereto a figure 8 shaped attachment loop, which can be manually positioned on the hanger arm astride the V-notch therein. Upon winding up of the rubberband, the loop adjacent the V-shaped notch will, because of the torque exerted thereon by the rubberband, rotate around the mounting thereof on the hanger arm until it reaches a position wherein the respective sides of the loop are braced against the sides of the hanger arm by the torque. Upon release of the rubberband powered propeller and subsequent unwinding of the rubberband, a delayed-release of the propulsion mechanism will be effected. The torque bracing of the attachment loop against the hanger arm is relaxed upon complete unwinding of the rubberband, resulting in the attachment loop sliding down and off the inclined hanger arm. The residual energy in the rubberband then will effect propulsion of the rubberband and associated propeller structure away from the model airplane.

10 Claims, 5 Drawing Figures

DELAYED-RELEASE SUSPENSION DEVICE

This application is a continuation-in-part of application Ser. No. 636,864, filed Aug. 2, 1984, now abandoned.

BACKGROUND OF THE INVENTION

1. Field of the Invention

This invention relates generally to devices for rubberband powered flying toys having a delayed-release suspension system therewith.

2. Description of the Prior Art

A common problem with known devices for releasing a propulsion mechanism of rubberband powered flying airplanes is that the systems used today are unduly complex and sometimes even fail in operation. Some of the known devices for delayed-release suspension of the power mechanism of flying airplanes have the problem of not being as predictable in the holding and releasing characeteristics as desired. Furthermore, they are not as simple to manipulate or operate as desired. Also, a certain degree of manual dexterity is required for proper operation of known type devices.

Existing prior patents which may be pertinent to the present invention are as follows:

U.S. Pat. No. 3,128,574—4/14/64—B. Sunray
U.S. Pat. No. 3,174,252—3/23/65—B. Sunray
U.S. Pat. No. 3,360,229—12/26/67—G. R. Beyer
U.S. Pat. No. 3,964,189—6/22/76—Belokin, Jr.

U.S. Pat. Nos. 3,128,574 and 3,174,252 to the same inventor as the present application show the type of structure of which the present invention is an improvement over. Both of these delayed-suspension release systems require fairly complex mechanisms and a certain amount of manual dexterity on the part of the user. The present invention is far simpler to use and overcomes the difficulties presented by these prior devices.

The subject invention is also a major advance over the hanger structure for picture and mirror frames as disclosed by the Beyer Patent, as well as the somewhat figure-8-shaped attachment hook 28 of the Belokin, Jr. patent. Neither of these latter patents offer the new and novel features of the present invention.

SUMMARY OF THE INVENTION

An object of the present invention is to provide an improved novel delayed-release suspension structure for use with rubberband powered airplanes which will permit the detachment of the propulsion system of the airplane after the energy of the rubberband has been dispensed into flight of the plane.

Another object of the present invention is to provide a simplified and easy to use structure for release of rubberband powered propulsion structure which requires a greatly reduced degree of manual dexterity for overall operation thereof.

A further object of this invention is to provide a delayed-release suspension structure which has desirable holding and releasing characteristics, and yet is very simple to manipulate and operate.

A still further object of the present invention is to provide a suspension structure which does not require a companion coupling, and which can be secured directly to the glider or airplane body.

Another further object of the present invention is to provide a suspension structure which structurally has much greater simplicity with resulting simplification of operation thereof, as well as lower initial costs.

The present invention has a number of new and novel features. Among them are the fact that only a very simple hanger arm which can be mounted directly to a glider body is required, a very simple notch being provided therein for mating and supporting a figure-8-shaped wire loop for attachment of the rubberband powered mechanism to the overall glider.

The present structure comprises a fixed wire arm which is affixed by suitable adhesive to the front end of a glider. This wire arm is slanted backwardly in the range of 10° to 25°. Midway of the exposed portion of this hanger arm a notch of generally V-shape configuration is provided in the leading edge. This notch cooperates with an attachment loop of wire in a figure-8-configuration. One end of the wire thus can be engaged with the notch of the fixed wire arm, while the other end is attached to the fore end of the rubberband attached to the glider propulsion mechanism.

Basically, in its simplest form, the tension of the rubberband maintains the figure-8 loop within the V-notch initially, and after the propeller has been suitably rotated to wind up the rubberband motor, the figure 8 will rotate slightly about the hanger arm and then be retained by the counter torque exerted by the arm against the compression of the rubberband. Then, when the glider is launched and the rubberband powered propeller drives the glider upwardly into the sky, after the energy of the rubberband has been expended, the loop will release from the hanger arm and allow the rubberband and associated propeller propulsion system to eject and detach from the glider. At this point the glider wings then will open and the glider will descend downwardly in a normal fashion.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
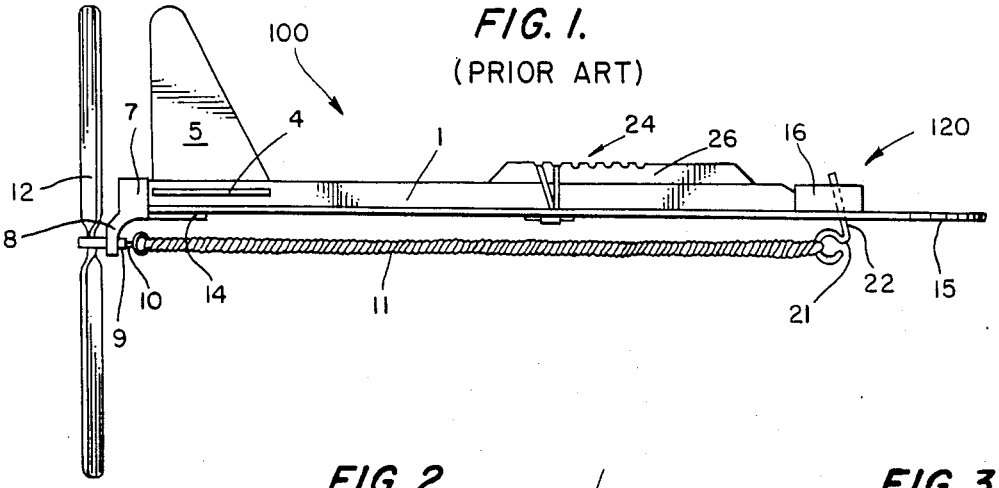
FIG. 1. (PRIOR ART)
FIG. 1 is a side elevational view of the prior art device. This is like the device disclosed in applicant's prior patents, mentioned above.

Referring to FIG. 1 of the drawing, reference numeral 120 indicates in general the portion of a glider of the prior art where the present invention is affixed. This prior art device as depicted in FIG. 1 is like that of applicant's prior U.S. Pat. No. 3,174,252, granted on Mar. 23, 1965. The structure disclosed in this patent is specifically incorporated herein by reference thereto. The important elements thereof have been indicated by the same reference numerals as used in the patent. A glider fuselage 1 has a guiding air foil 5 attached at the rear thereof together with a stabilizing air foil 4. A cap 7 of plastic or light metal is shaped and sized to fit over and about the rearward end of fuselage 1. An integral lug 8 supports a metal bearing 9 for journalling the propeller shaft 10 therein. The propeller 12 is affixed to the propeller shaft 10. The other end of shaft 10 has a loop therein for holding one end of the rubberband 11 which provides the propeller drive propulsion. The wings 15 are held in the folded position by the projection 14 on the propeller cap 7, as explained in detail in the aforementioned patent. In this earlier patented device, the sleeve 16 is used with the terminal end 22 of the clip 21 for holding the forward end of the rubberband. This structure, as disclosed in the patent, will release the rubberband front end and allow the propeller mechanism to be expelled rearwardly of the device, and then allow the folded wings 15 to open so the glider can descend. The wing structure 15 is pivoted at its central portion to the strut 1 as indicated generally at 24. Strip 26 is a ballast strip to permit changes in position of the wing pivot structure.

Figure 2:
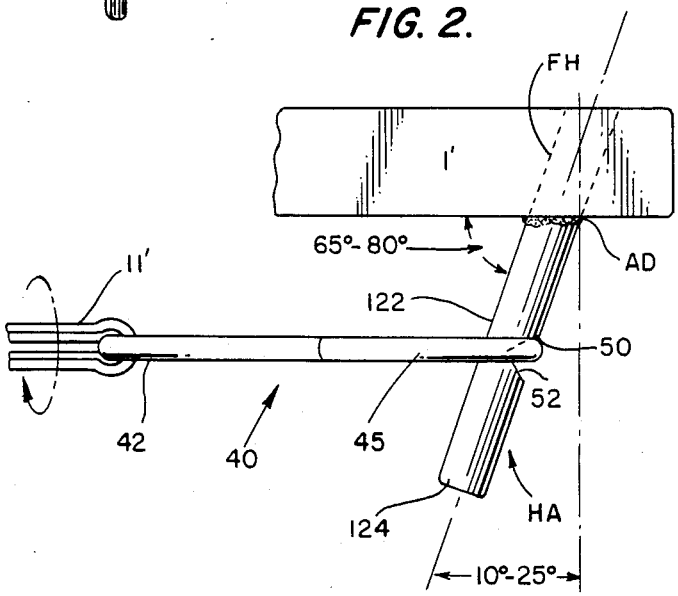
FIG. 2 is a side elevational view of the new and improved structure of the present invention.
Figure 3:
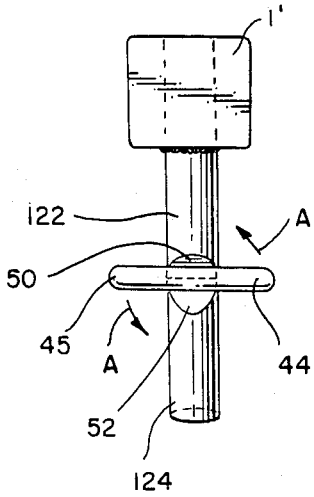
FIG. 3 is a front elevational view, depicting the start of the rubberband winding up process.

The present invention is depicted in FIGS. 2–5 of the drawings. This structure is affixed at the forward end of a glider such as 1 of the prior art device. Such a fuselage is depicted as 1' in these figures. The overall structure comprises a hanger arm preferably of a straight piece of wire which is round in circumference. It is of suitable length, an inch or so, and of sufficient thickness to resist bending when the rubberband 11' for the propeller is fully wound. Suitable adhesive AD affixes the terminal end of the hanger arm to the fuselage 1'. The hole indicated in dotted lines FH is drilled or formed at a suitable angle from a perpendicular to the longitudinal axis of the fuselage. It has been discovered that a range of from 10° to 25° is suitable for this angle, as can be seen in FIG. 2 of the drawings. Midway of the portion extending from the fuselage is a V-shaped notch VN. This notch has an upper surface 50 and a lower surface 52, as shown in these figures. As can be seen, because of the backward inclination of the hanger arm HA, the upper surface of the notch 50 will be more nearly horizontal than that of the surface 52 of the lower portion. This notch also separates the hanger arm into an upper portion 122 and a lower portion 124.

Figure 5:
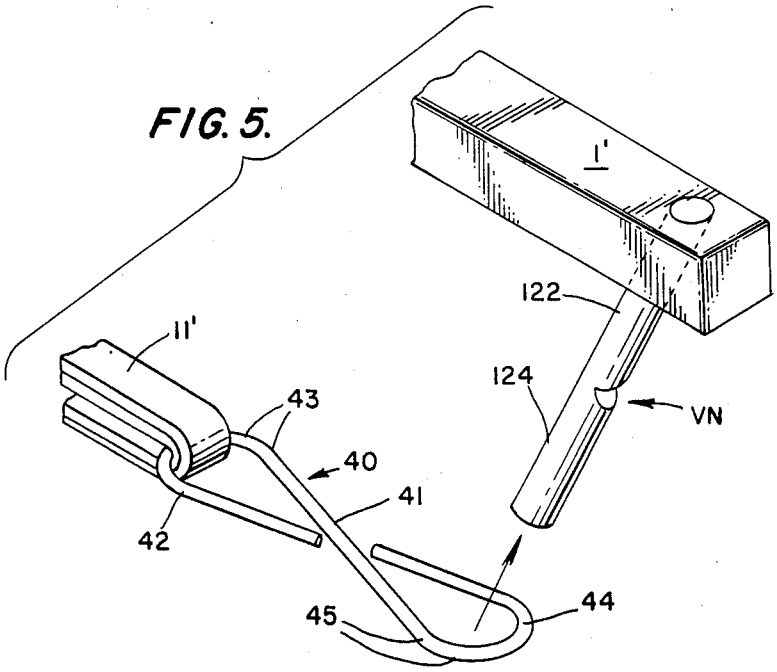
FIG. 5 is a perspective view of the component elements of the present invention.

As best seen in FIG. 5, the forward end of the rubberband 11' can be affixed or temporarily attached to the hanger arm HA by a figure-8-shaped loop 40. This loop has a straight portion 41 connecting the respective curved ends or loops 45 and 43. Curving portions of these curved or looped ends are provided as depicted by reference numerals 42 and 44.

The method of use of the present invention will now be described in detail. Initially, the wire suspension loop is manually positioned astride the V-notch section of the hanger arm HA. The retention loop 45 of the suspension loop 40 is thus retained, unattended, by the. residual stretch of the rubberband 11'. Then, when the propeller is rotated to wind up the rubberband 11', a torque bracing effect takes place. As best seen in the front view of FIG. 3, as the rubberband begins to come under tension, the retention loop 45 of the suspension loop 40 will turn axially with the twisting rubberband, and attempt to brace itself against both sides of the wire hanger arm HA (see reference letter A).

Figure 4:
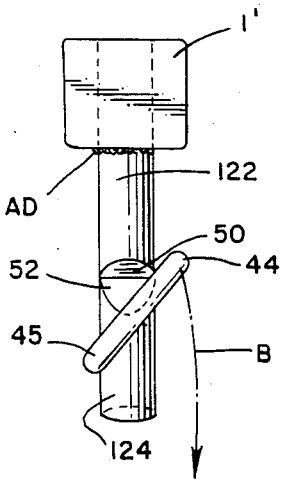
FIG. 4 is a front elevational view, depicting the end release portion of the overall system.

As increased torque is exerted on the rubberband, the axially turning loop is automatically moved or shunted out of the retaining V-notch VN of the hanger arm. Thus moved out of the notch, the loop will be in a holding position, as depicted in FIG. 4, with the retention loop 45 diagonally astride the inclined pre-release section 124 of the hanger arm. Of course, the tension of the wound up rubberband 11' will hold the suspension loop 40 in this position. This is because of the combination force of the counterclockwise torque bracing effect, together with the portion of the V-notch which the retention loop 45 still engages.

Upon launching the airplane and the propeller 12 unwinding, the rubberband 11' fully untwists. Upon final untwisting, the torque bracing effect exerted on the suspension loop 40 is relaxed, and the suspension loop is free to slide down and off the inclined hanger arm HA. Once the suspension loop disengages entirely from the hanger arm, the slight residual energy remaining in the rubberband 11' creates a backward force which will eject the propeller cap 7 rearwardly from the airplane, and thus allow the wings 15 thereof to expand to the open position.

As can be readily visualized, the present invention offers a number of new and desirable features over the prior art, even applicant's own devices. The device is quite simple, easy to manufacture and install, and can actually be retrofitted to existing prior art type devices.

The system also is relatively failsafe, very simple and easy to use, and in actual use, far superior to all known type devices.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

I claim:

1. A toy aircraft having a rubber band-powered propulsion mechanism and including a fuselage having a longitudinal axis; a substantially straight hanger arm underneath the fuselage, permanently affixed near the front end of said fuselage and inclined toward the rear end thereof at an angle of at least 10° to the vertical; said aircraft further including means for retaining thereon the propulsion means while the rubber band is wound and tensioned and for releasing therefrom the propulsion mechanism upon unwinding and relaxation of the rubber band, the retaining and releasing means including a rigid member for attaching the rubber band to the hanger arm.

2. The suspension structure of claim 1, wherein said hanger arm includes a V-shaped notch provided in a leading edge of said hanger arm.

3. The suspension structure of claim 2, wherein said angle is in the range of 10° to 25°.

4. The suspension structure of claim 3, wherein said rigid member is in the shape of a figure 8.

5. The suspension struture of claim 4 whrein said hanger arm is affixed to the fuselage of said model airplane by adhesive.

6. The suspension structure of claim 1, wherein said hanger arm is affixed to the fuselage of said model airplane by adhesive, and is inclined rearwardly thereof at a preset anglė from 10° to 25°.

7. The suspension structure of claim 6, wherein said hanger arm includes a V-shaped notch provided in said hanger arm.

8. The suspension structure of claim 7, wherein said rigid member includes a pair of back-to-back loops.

9. A method of use of a delayed-release suspension system for a rubberband powered model airplane comprising the following steps:

affixing one end of a hanger arm to said airplane's fuselage at an angle of at least 10° from a perpendicular to the longitudinal axis of the fuselage;

attaching one end of a rubberband of said model airplane to the free end of the hanger arm;

said attachment utilizing a structure having a retention loop; and rotating the rubberband to wind same up and thus effecting a torque bracing rotation and engagement of the retention loop with the hanger arm for movement of the loop to a lower portion of the hanger arm so as to be in a pre-release position thereon.

10. The method of use of claim 9, wherein the rubberband is allowed to untwist, and the retention loop in the pre-release position on said hanger arm becomes completely disengaged from said hanger arm upon complete unwinding of the rubberband.

* * * * *